US005395093A

United States Patent [19]

Chrisman

[11] Patent Number: 5,395,093

[45] Date of Patent: Mar. 7, 1995

[54] T-POST EXTENDER

[76] Inventor: Lawrence C. Chrisman, 7830 W. County Rd. 20, Loveland, Colo. 80537

[21] Appl. No.: 85,828

[22] Filed: Jul. 6, 1993

[51] Int. Cl.[6] ..... E04H 17/02

[52] U.S. Cl. ..... 256/47; 403/278; 256/48

[58] Field of Search ..... 256/34, 47, 48; 403/278, 281, 282

[56] References Cited

U.S. PATENT DOCUMENTS

| | | | |
|---|---|---|---|
| 684,096 | 10/1901 | Price | 256/47 |
| 1,454,649 | 5/1923 | Murton | 256/47 |
| 4,426,761 | 1/1984 | Sassak | 403/278 |
| 4,469,465 | 9/1984 | Andrus | 403/282 |
| 4,631,797 | 12/1986 | Hill | 403/278 |

FOREIGN PATENT DOCUMENTS

| | | | |
|---|---|---|---|
| 3216880 | 11/1983 | Germany | 403/282 |
| 0622063 | 4/1949 | United Kingdom | 256/47 |

*Primary Examiner*—Edward K. Look
*Assistant Examiner*—Mark Sgantzos
*Attorney, Agent, or Firm*—Hugh H. Drake

[57] ABSTRACT

A T-post fence extender is formed from a cylindrical tube by swedging both end portions of the tube while leaving the central portion as a cylinder. In an alternative the tube is swedged throughout its length. Each swedged portion has a cross-section similar to that of a studded T-post and is sized to fit closely over the end of the T-post. Once in place, the extender may be welded to the T-post, the marginal end portions of the extender may be struck so as to be formed against the T-post between adjacent studs or a slot may be cut out to define a finger which may be deformed inwardly to seat between adjacent studs. The extender may be used either to raise the height of an existing fence or to erect a high fence from the beginning.

9 Claims, 1 Drawing Sheet

FIG. 1
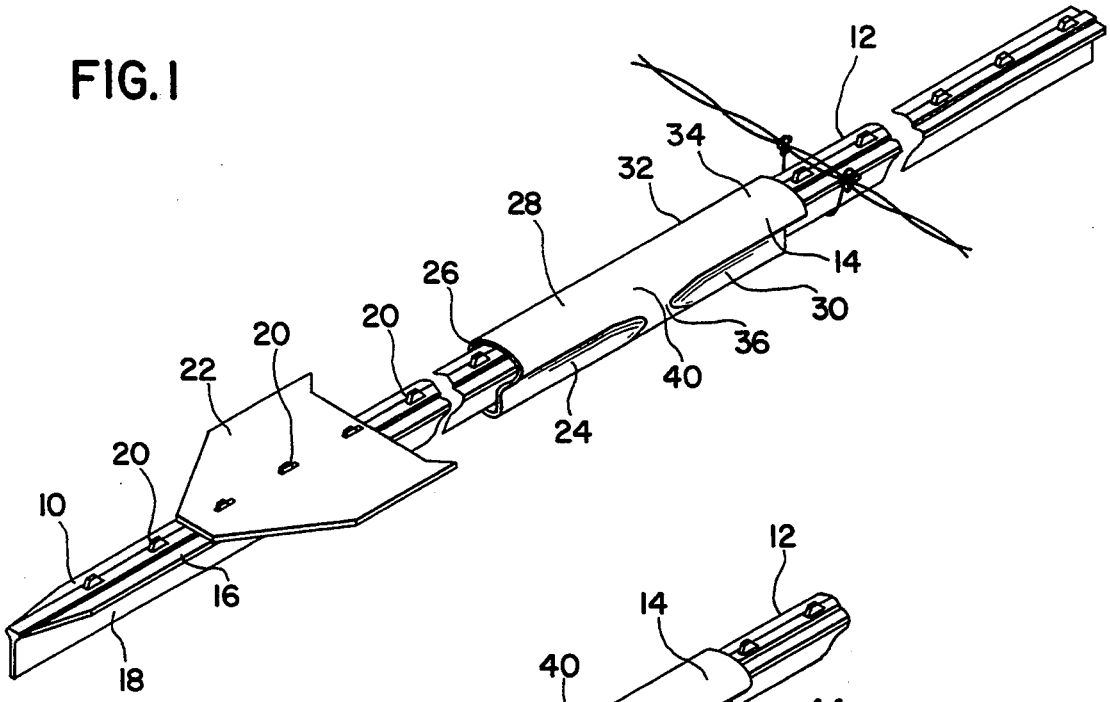
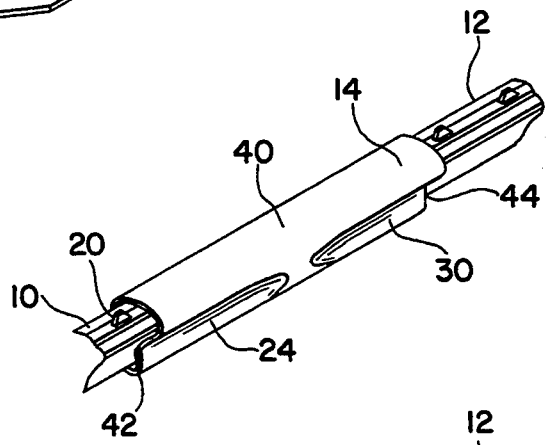
FIG. 2
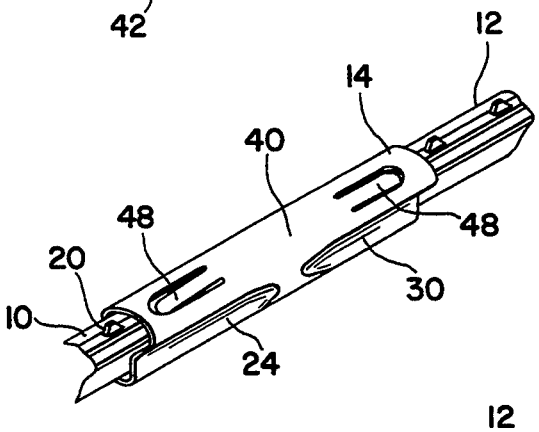
FIG. 3
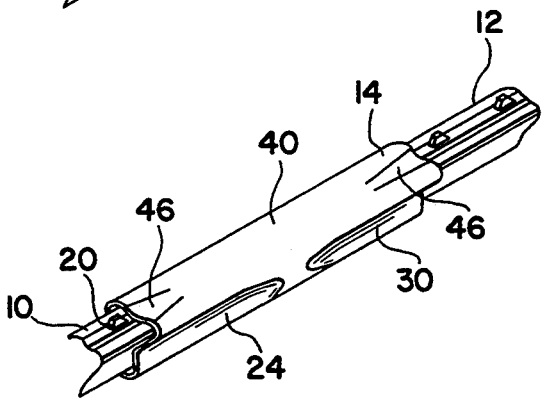
FIG. 4

T-POST EXTENDER

The present invention relates to T-post Extenders. More particularly it pertains to a coupling seated over the upper end of a studded T-post and which extender in turn is received over the lower end of a second studded T-post.

T-posts have found widespread use in fencing along the boundry of a plot of ground. One end of each post is driven into the ground by use of a manually-swung sledge hammer, a manually-operated post driver in the form of a closed cylinder usually having handles which are grasped by the user or preferably by means of a compressed-air-driven pneumatic hammer provided with a fitting that mounts on the upper end of the post.

The posts have a T-shaped cross section which gives them their name and they are made of hot-rolled steel. That process produces a post which is of sufficient rigidity to enable the post to be driven into ground which is highly compacted and through which as the end of the post moves it is capable of dislodging and often even fracturing small rocks which may be encounterd. When a large rock mass is encountered, a hole may first be drilled to a diameter which is slightly smaller than the transverse dimension of the post in which case the post is then driven forceably into the hole formed in the rock mass.

A succession of the posts are installed along a line with a typical post-to-post spacing being one rod or sixteen and one-half feet. Several strands of wire, either barbed or plain, are then stretched along the series of posts and fastened individually to the posts with each strand being spaced one above the next. Stiff wire cleats often are used to fasten the individual strands in place as they cross the posts with each strand being located against the outer face of the bar of the T-section so as to rest between an adjacent pair of a series of studs formed along the length of each post. Those studs serve to lock the wire in place at a predetermined height and guard against displacement of the wire when it may be pressured toward movement either higher or lower.

To make a typical four- or five-strand fence, each T-post typically will have a length of six feet and can be driven into the ground about two feet so as to result in a fence which is four feet high. That height has been found to be sufficient to restrain most domesticated livestock such as cattle, horses and llamas. However, that height will usually be found to be insufficient for restraining some breeds of horses as well as many varieties of wild animals such as deer, elk and buffalo. The confinement and raising of the latter animals has in recent years become a fast growing segment of the livestock industry.

Thus, there is a need for higher fencing up to a level of ten or twelve feet. In a typical situation either an existing four foot fence may need to be raised in height or the existing fence must be removed and replaced by a higher fence. For cost effectiveness, a preference may well exist for raising the existing fence. But even when installing a new fence it may be found to be easier and safer to complete the installation of a new fence by first installing an ordinary fence of normal height and then extending that fence to make it higher.

It is an object of the present invention to provide a new and improved coupling for joining together aligned studded T-posts.

Another object of the present invention is to provide a new and improved T-post coupling which is easy to manufacture in a cost-efficient manner.

A further object of the present invention is to provide a new and improved T-post coupling which is capable of being securely affixed in place on the end of a T-post.

In accordance with the present invention a coupling is intended for the joining together of studded T-posts aligned end to end. It is in the form of a rigid elongated tube and receivable over adjacent end portions of an aligned pair of studded T-posts. The tube has a curved circumferential sector throughout its length and sized to closely overlie ensleeved studs and bar portions of a T-post. Circumferentially beyond the sector the opposing end portions of the tube are each crimped inwardly to a position in which to lie closely adjacently to and wrap beneath the bar and alongside and around the free end of the leg of the T-post when assembled.

The features of the present invention which are believed to be patentable are set forth with particularity in the appended claims. The organization and manner of operation of the invention, together with further objects and advantages thereof, may best be understood by reference to the following description taken in connection with the accompanying drawings in the several figures of which like numbers identify like elements, and in which:

FIG. 1 is an isometric view of a T-post and coupling assembly;

FIG. 2 is a fragmentary isometric view of a first embodiment of an assembled T-post assembly;

FIG. 3 is a second similar isometric view of another embodiment of a T-post and coupling assembly; and FIG. 4 is a fragmentary isometric view of a further alternative embodiment of a coupling and T-post assembly.

Referring to FIG. 1, a pair of T-posts 10 and 12 are joined in end-to-end relationship by a coupling 14. Posts 10 and 12 each have a T-shaped cross section so as to include a bar 16 disposed across the top of a leg 18. Such posts are fabricated out of hot-rolled steel and in the process of manufacture are produced to include along the outer face of bar 16 a succession of individually-spaced studs 20.

Preferably secured to the bar of post 10 is a spade 22 in the form of a rigid steel plate which may be staked in place on bar 10 by having been provided with openings which are placed over several adjacent ones of studs 20 that then have been peened over to firmly secure the plate to post 12. During the driving of the lower end of post 10 into the ground, spade 22 serves to resist against rotation of the post as it penetrates the ground. Spade 22 also serves to anchor the post in the ground after installation.

A typical steel post will have a bar 16 of a width of one and three eighths inch with leg 18 having a height also of one and three eighths inch. The thickness of bar 16 and leg 18 is about one eighth inch. After installation, such posts may be flexed laterally at their top a few inches one way or another. But when given additional lateral support by the installed and stretched wire strands, the post becomes highly rigid and durable.

To extend the length of the post, coupling 14 is ensleeved over the upper end of post 10. Coupling 14 is formed of commercial grade steel tubing. One end portion is cold extruded through a die to swedge opposite recesses 24 and 26 in terminal portion 28 of coupling 14. Similarly formed in the other end of coupling 14 are recesses 30 and 32 swedged into an opposite terminal portion 34. This process leaves a central portion 36 intermediate the terminal portions that completes with a curved-circumferential sector 40 the definition of a cylinder. Circumferential sector 40 continues over the entire length of coupling tube 14. Terminal portions 28 and 34 are disposed beyond central portion 36 and each are crimped inwardly to a position in which to lie closely adjacent to and wrapped beneath bar 16 and alongside and around the free end of leg 18 of the tee when assembled.

The second section in the form of T-post 12, of course, does not include a spade 22. To reach the ultimate fence height, coupling 14 first has its end portion 28 installed over the upper end of post 10 after which the second post 12 is inserted into upper end portion 34 of coupling 14.

After installation of coupling 14 it is preferred as shown in FIG. 2 to rigidify the complete assembly by forming weldments 42 and 44 between the respective legs 18 and the outer ends of the crimped portions 28 and 34, respectively. In the alternative of FIG. 4, however, each end of coupling 14 may be tightened into place on posts 10 and 12 by using a tool like a ball peen hammer and striking the extreme terminal end portion of coupling 14 as at 46. While coupling 14 is in itself rigid, the exposed free end of the circumferential sector of coupling 14 remains sufficiently deformable to be pounded down and into fixed position between studs and against the face of bar 16. To that end, coupling 14 in this embodiment preferably is made of sixteen guage material.

In another alternative depicted in FIG. 3, the wall of the circumferential sector near each end of coupling 14 is cut through in order to define a finger 48. After installation of coupling 14 upon the post, the free end of finger 48 is deformed into the space between adjacent studs on the ensleeved post by striking it with a tool such as the pointed protrusion on a conventional pair of fence pliers.

In a further alternative, space-opposed recesses 24 and 26 are swedged to continue throughout the entire length of coupling tube 14. Sector 40 also continues the entire length as before. Central portion 36 becomes instead part of the crimped recesses.

For raising the height of an existing fence of approximately three to six feet in height, it will be observed that a single workman easily can install coupling 14 over the upper end of each already-present T-post. The same workman or another is then able to insert from above the lower end of the extension T-post. After installation of the latter, the ends of coupling 14 are exposed so as to enable either the welding of FIG. 2, the deformation of FIG. 4 or the depression of finger 48 of FIG. 3. Often it will be found that sufficient rigidity results in the completed installation that it is necessary to weld, bend down or deform the tab only at one end of coupling 14. Desirably, such work might be carried out with the worker or workers being carried on the bed of a vehicle. Either the availability of such a vehicle or scaffolding is of course suggested for stringing and tensioning the additional strands of wire along the newly-installed upper fence posts.

The basic concept is that of extending the height of existing fences. Nevertheless, the same two-post approach is advantageous even when installing new fencing. This is because the typical T-post length of six feet represents about the limit of what conveniently can be handled by a single installer. Posts of greater length exceed the reach of the average person at the same time as the weight of the posts tends to become excessive for many persons. Of course, posts having lengths of ten or twelve feet may be installed initially. However, those are found to be extremely awkward for handling even by two persons. They are heavy and they exhibit sufficient flexibility that their top ends sway a considerable distance back and forth during the eventual attempt to string the strands of wire. Subsequent fence repairs also will be found to be easier if the posts can be replaced in two sections rather than one.

While particular embodiments of the present invention have been shown and described, and alternatives have been explained, it will be obvious to those skilled in the art that changes and modifications may be made without departing from the invention in its broader aspects. Therefore, the aim in the appended claims is to cover all such changes and modifications as fall within the true spirit and scope of that which is patentable.

I claim:

1. A post assembly comprising:

a pair of elongated rigid posts aligned end to end with each of said posts being of T-shaped cross section, includinq a bar disposed across the top of a leq, and having a succession of outwardly projecting studs distributed longitudinally along said bar of said tee;

a rigid elongated tube ensleeved over adjacent end portions of said posts and having a curved circumferential sector closely overlying the corresponding studs and bar portions with the terminal portions of said tube each being crimped inwardly to lie closely adjacent to and wrap beneath the bar and alongside and around the free end of the leg of the tee;

and means for securing at least one end of said tube to the adjacent portion of the corresponding one of said posts.

2. A post assembly as defined in claim 1 in which said said securing means is a weldment between the leg of said tee and the adjacent terminal portion.

3. A post assembly as defined in claim 1 in which said securing means is an inwardly directed deformation of a terminal region of said curved circumferential sector to bend inwardly and seat between adjacent ones of said studs.

4. A post assembly as defined in claim 1 in which said securing means is a finger formed into the terminal wall portion of said curved circumferential sector and bent inwardly to seat between adjacent ones of said studs.

5. A coupling as defined in claim 1 in which the remaining circumference of said tube completes a cylinder over a longitudinally central portion of said tube.

6. A coupling for joining together studded T-posts, each including a bar disposed across the top of a leg, aligned end to end and comprising:

a rigid elongated tube ensleevable over adjacent end portions of an aligned pair of studded T-posts, said tube having a curved circumferential sector sized to closely overlie ensleeved studs and bar portions of said T-posts with the terminal portions of said tube each being crimped inwardly to a position in which to lie closely adjacent to and wrap beneath the bar and alongside and around the free end of the leg of the correspondinq tee when assembled. tube.

7. A coupling as defined in claim 6 in which a terminal region of said curved circumferential sector is deformable inwardly in response to a manually-applied hammer blow to seat between adjacent studs on a T-post.

8. A coupling as defined in claim 6 in which a finger is formed into the terminal wall portion of said curved circumferential sector and is bendable inwardly to seat between adjacent ones of said studs.

9. A coupling as defined in claim 6 in which the remaining circumference of said tube completes a cylinder over a longitudinally central portion of said tube.

* * * * *